US010809640B2

(12) United States Patent
Iwasaki et al.

(10) Patent No.: US 10,809,640 B2
(45) Date of Patent: Oct. 20, 2020

(54) TONER

(71) Applicant: CANON KABUSHIKI KAISHA, Tokyo (JP)

(72) Inventors: Yosuke Iwasaki, Abiko (JP); Kenta Mitsuiki, Toride (JP); Wakiko Katsumata, Kashiwa (JP); Takeshi Ohtsu, Toride (JP); Masaharu Miura, Toride (JP); Koh Ishigami, Abiko (JP); Takakuni Kobori, Toride (JP); Takaho Shibata, Tokyo (JP); Daisuke Yamashita, Matsudo (JP); Hitoshi Sano, Matsudo (JP); Ryo Nakajima, Nagareyama (JP); Rei Hijikawa, Kashiwa (JP); Yuichi Mizo, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/551,351

(22) Filed: Aug. 26, 2019

(65) Prior Publication Data

US 2020/0073264 A1 Mar. 5, 2020

(30) Foreign Application Priority Data

Aug. 31, 2018 (JP) ..... 2018/163853

(51) Int. Cl.

| | |
|---|---|
| ***G03G 9/087*** | (2006.01) |
| ***G03G 9/097*** | (2006.01) |
| ***G03G 9/08*** | (2006.01) |

(52) U.S. Cl.

CPC ..... *G03G 9/08786* (2013.01); *G03G 9/081* (2013.01); *G03G 9/08704* (2013.01); *G03G 9/08755* (2013.01); *G03G 9/09783* (2013.01)

(58) Field of Classification Search

CPC ..... G03G 9/09783; G03G 9/08786; G03G 9/08755; G03G 9/08704

See application file for complete search history.

(56) References Cited

U.S. PATENT DOCUMENTS

| | | | | |
|---|---|---|---|---|
| 5,478,686 | A * | 12/1995 | Kawakami | G03G 9/08704 430/108.8 |
| 9,969,834 | B2 * | 5/2018 | Ohtsu | C08F 255/02 |
| 2017/0269493 | A1 * | 9/2017 | Ohtsu | G03G 9/08755 |
| 2018/0059565 | A1 * | 3/2018 | Kamae | G03G 9/0827 |

FOREIGN PATENT DOCUMENTS

| | | | | |
|---|---|---|---|---|
| CA | 1119870 | A * | 3/1982 | |
| JP | 04362656 | A * | 12/1992 | |
| JP | 2001022128 | A * | 1/2001 | |
| JP | 2008020631 | A * | 1/2008 | |
| JP | 2013-064822 | A | 4/2013 | |
| WO | WO-2012157713 | A1 * | 11/2012 | G03G 9/09733 |

OTHER PUBLICATIONS

English language machine translation of JP 04-362656 (Year: 1992).*
English language machine translation of JP 2001-022128 (Year: 2001).*

* cited by examiner

*Primary Examiner* — Christopher D Rodee
(74) *Attorney, Agent, or Firm* — Canon U.S.A., Inc. IP Division

(57) ABSTRACT

A toner that is suppressed from deteriorating owing to its long-term use and can maintain high transferability. The toner includes: a toner particle containing an amorphous polyester serving as a binder resin and a polymer A; and inorganic fine particles, wherein the polymer A includes a graft copolymer of a polyolefin and a vinyl-based polymer unit having a carboxylate anion group, and a metal ion having a valence of 2 or more.

4 Claims, 1 Drawing Sheet

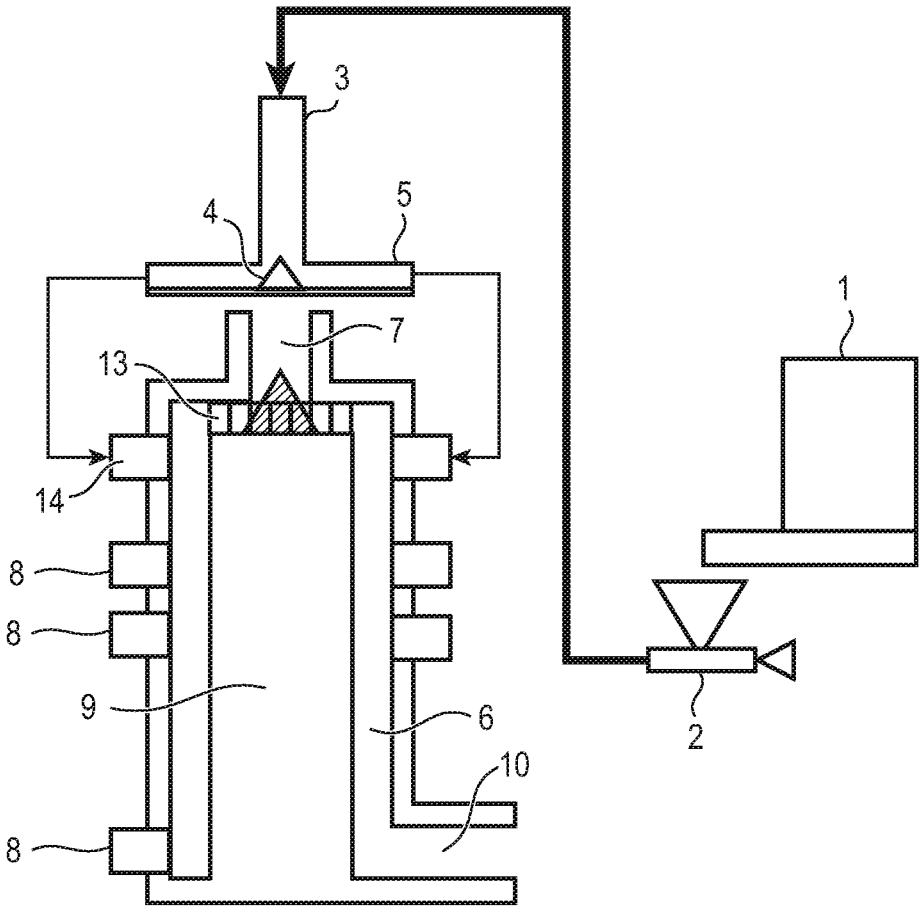
3
4
5
1
7
13
14
8
8
9
6
10
8
2

TONER

BACKGROUND OF THE INVENTION

Field of the Invention

The present disclosure relates to a toner to be used in an electrophotographic system, an electrostatic recording system, an electrostatic printing system, or a toner jet system.

Description of the Related Art

In recent years, an electrophotographic full-color copying machine has become widespread and its application to a printing market has started. In the printing market, the copying machine has started to be required to achieve a high speed, high image quality, and high productivity while corresponding to a wide variety of media (paper kinds). In recent years, an increase in speed of the copying machine, the stability of an output image, and the like have been required, and hence the development of a toner having high stress resistance has been required more than ever before.

In order to improve the stress resistance of a toner excellent in low-temperature fixability, a toner in which inorganic fine particles having different particle diameters are caused to adhere to the surface of a toner particle has been proposed (see Japanese Patent Application Laid-Open No. 2013-064822). In this case, the inorganic fine particles on the surface of the toner particle exhibit a certain effect on the durability of the toner in a developing unit. However, for example, when the inorganic fine particles peel from the surface owing to long-term use of the toner, the effect fades. In other words, the toner has room for further improvement in terms of an improvement in stress resistance of the toner particle itself.

SUMMARY OF THE INVENTION

An object of one aspect of the present disclosure is to provide a toner that has solved such disadvantage as described above and is suppressed from deteriorating owing to its long-term use.

One aspect of the present disclosure relates to a toner including: a toner particle containing an amorphous polyester serving as a binder resin and a polymer A; and inorganic fine particles, wherein the polymer A includes a graft copolymer of a polyolefin and a vinyl-based polymer unit having a carboxylate anion group, and a metal ion having a valence of 2 or more.

According to one aspect of the present disclosure, the toner that is suppressed from deteriorating owing to its long-term use can be provided.

Further features of the present disclosure will become apparent from the following description of exemplary embodiments with reference to the attached drawing.

BRIEF DESCRIPTION OF THE DRAWINGS

FIGURE is a view of a heat sphering treatment apparatus to be used in one embodiment of the present disclosure.

DESCRIPTION OF THE EMBODIMENTS

The configuration of a toner preferred in one embodiment of the present disclosure is described in detail below.

The present disclosure provides a toner including: a toner particle containing an amorphous polyester serving as a binder resin and a polymer A; and inorganic fine particles, wherein the polymer A includes a graft copolymer of a polyolefin and a vinyl-based polymer unit having a carboxylate anion group, and a metal ion having a valence of 2 or more.

The present inventors have considered the mechanism via which the deterioration of the toner due to its long-term use is suppressed to be as described below.

The polymer A including the graft copolymer in which the vinyl-based polymer unit having a carboxylate anion group is graft-copolymerized with the polyolefin, and the metal ion having a valence of 2 or more expresses an aggregating force based on the metal ion in the toner particle. In other words, the polymer A is assumed to serve as an ionomer. The present inventors have assumed that the strength of the toner particle was improved by the ionomer, and hence the suppression of the deterioration due to the long-term use was able to be satisfied.

The configuration of a preferred material is described below.

<Polymer A>

The toner according to one embodiment of the present disclosure includes the polymer (ionomer) including the graft copolymer of the polyolefin and the vinyl-based polymer unit having a carboxylate anion group, and the metal ion element having a valence of 2 or more. The molecules of the graft copolymer are aggregated by the action of the metal ion having a valence of 2 or more, and hence the polymer serves as an ionomer as a whole. As a result, the strength of the toner itself is improved, and hence the deterioration of the toner due to its long-term use can be suppressed.

It is important that the valence of the metal ion be 2 or more. When the valence is 2 or more, an effect of incorporating the ionomer into the toner is strongly expressed, and hence the strength of the toner particle is improved. In one embodiment of the present disclosure, the metal ion only needs to be a metal ion that is divalent or more, and suitable examples thereof may include the ions of magnesium, calcium, strontium, barium, and aluminum. The metal ion is preferably added in an amount equal to the total sum of the valences of the carboxylate anion groups. The amount of the metal ion in the polymer A is preferably 2 mass % or more and 10 mass % or less with respect to the mass of the polymer A.

The content of a monomer unit having a carboxylate anion group in the polymer A is preferably 2 mass % or more and 12 mass % or less with respect to the mass of the polymer A.

The weight-average molecular weight (Mw) of the graft copolymer forming the polymer A is preferably 5,000 or more and 70,000 or less in a molecular weight distribution by GPC in terms of a styrene-acrylic resin.

In one embodiment of the present disclosure, suitable examples of the polyolefin may include hydrocarbon-based waxes, such as low-molecular weight polyethylene, low-molecular weight polypropylene, an alkylene copolymer, microcrystalline wax, and paraffin wax. The content of the polyolefin is preferably 5 mass % or more and 15 mass % or less with respect to the mass of the polymer A.

In addition, from the viewpoint of reactivity at the time of the production of the polymer A, the polyolefin preferably has a branched structure like polypropylene.

In one embodiment of the present disclosure, a method of graft-copolymerizing the polyolefin and the vinyl-based polymer unit is not particularly limited, and a conventionally known method may be used.

In the polymer A according to one embodiment of the present disclosure, the vinyl-based polymer unit preferably has a unit derived from a cycloalkyl (meth)acrylate.

A cycloalkyl group of the unit derived from the cycloalkyl (meth)acrylate monomer is preferably a saturated alicyclic hydrocarbon group having 3 or more and 18 or less carbon atoms, more preferably a saturated alicyclic hydrocarbon group having 4 or more and 12 or less carbon atoms. The saturated alicyclic hydrocarbon group encompasses, for example, a monocyclic saturated alicyclic hydrocarbon group, a condensed polycyclic hydrocarbon group, a bridged-ring hydrocarbon group, and a spiro hydrocarbon group.

Examples of such saturated alicyclic hydrocarbon group may include a cyclopropyl group, a cyclobutyl group, a cyclopentyl group, a cyclohexyl group, a t-butylcyclohexyl group, a cycloheptyl group, a cyclooctyl group, a tricyclodecanyl group, a decahydro-2-naphthyl group, a tricyclo[5.2.1.02,6]decan-8-yl group, a pentacyclopentadecanyl group, an isobornyl group, an adamantyl group, a dicyclopentanyl group, and a tricyclopentanyl group.

In addition, the saturated alicyclic hydrocarbon group may have, as a substituent, an alkyl group, a halogen atom, a carboxy group, a carbonyl group, or a hydroxy group. The alkyl group serving as the substituent is preferably an alkyl group having 1 to 4 carbon atoms.

Of those saturated alicyclic hydrocarbon groups, a monocyclic saturated alicyclic hydrocarbon group having 3 or more and 18 or less carbon atoms, a substituted or unsubstituted dicyclopentanyl group, or a substituted or unsubstituted tricyclopentanyl group is more preferred, a cycloalkyl group having 6 or more and 10 or less carbon atoms is still more preferred, and a cyclohexyl group is particularly preferred.

The substitution positions and number of the substituents are arbitrary, and when the saturated alicyclic hydrocarbon group has two or more substituents, the substituents may be identical to or different from each other.

The vinyl-based polymer unit may be a homopolymer of a vinyl-based monomer (a) having a structural moiety derived from a saturated alicyclic compound, or may be a copolymer of the monomer and any other monomer (b).

Examples of the vinyl-based monomer (a) include: monomers, such as cyclopropyl acrylate, cyclobutyl acrylate, cyclopentyl acrylate, cyclohexyl acrylate, cycloheptyl acrylate, cyclooctyl acrylate, cyclopropyl methacrylate, cyclobutyl methacrylate, cyclopentyl methacrylate, cyclohexyl methacrylate, cycloheptyl methacrylate, cyclooctyl methacrylate, dihydrocyclopentadiethyl acrylate, dicyclopentanyl acrylate, and dicyclopentanyl methacrylate; and combinations thereof.

Of those, cyclohexyl acrylate, cycloheptyl acrylate, cyclooctyl acrylate, cyclohexyl methacrylate, cycloheptyl methacrylate, and cyclooctyl methacrylate are preferred from the viewpoint of hydrophobicity.

Examples of the other monomer (b) include: styrene-based monomers, such as styrene, p-methylstyrene, m-methylstyrene, p-methoxystyrene, p-hydroxystyrene, p-acetoxystyrene, vinyltoluene, ethyl styrene, phenylstyrene, and benzylstyrene; alkyl esters of unsaturated carboxylic acids (having 1 or more and 18 or less alkyl carbon atoms), such as methyl acrylate, ethyl acrylate, butyl acrylate, 2-ethylhexyl acrylate, methyl methacrylate, ethyl methacrylate, butyl methacrylate, and 2-ethylhexyl methacrylate; vinyl ester-based monomers, such as vinyl acetate; vinyl ether-based monomers, such as vinyl methyl ether; halogen element-containing vinyl-based monomers, such as vinyl chloride; diene-based monomers, such as butadiene and isobutylene; and combinations thereof.

In addition, for adjustment of the polarity, a monomer for adding an acid group or a hydroxy group may be added. Examples of the monomer for adding an acid group or a hydroxy group include acrylic acid, methacrylic acid, maleic anhydride, a maleic acid half ester, and 2-ethylhexyl acrylate.

In one embodiment of the present disclosure, the vinyl-based polymer unit preferably has a monomer unit represented by the following formula (2) from the viewpoint of the low-temperature fixability of the toner.

When the vinyl-based polymer unit has a monomer unit represented by the formula (2), its glass transition temperature (Tg) tends to reduce. As a result, the low-temperature fixability is further improved.

formula (2)

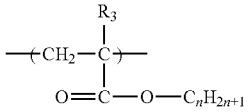

(In the formula (2), $R_3$ represents a hydrogen atom or a methyl group, and "n" represents an integer of 1 or more and 18 or less.)

In addition, the content of the polymer A in the toner is preferably 4.0 mass % or more and 12.0 mass % or less.

<Amorphous Polyester (Binder Resin)>

In the toner according to one embodiment of the present disclosure, the amorphous polyester to be used in the toner particle serves as a binder resin. A polyhydric alcohol (dihydric or trihydric or higher alcohol) and a polyvalent carboxylic acid (divalent or trivalent or higher carboxylic acid), or an acid anhydride or lower alkyl ester thereof are given as monomers to be used in the polyester. Here, the polyester is preferably a branched polymer, and partial crosslinking in a molecule thereof is effective in producing a branched polymer. To that end, a trivalent or higher polyfunctional compound is preferably used. Therefore, a trivalent or higher carboxylic acid, or an acid anhydride or lower alkyl ester thereof, and/or a trihydric or higher alcohol is preferably incorporated as a raw material monomer for the polyester.

The following polyhydric alcohols may each be used as a polyhydric alcohol serving as a monomer to be used in the polyester.

As a dihydric alcohol component, there are given, for example, ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, a bisphenol represented by the formula (A) and derivatives thereof, and a diol represented by the formula (B).

(A)

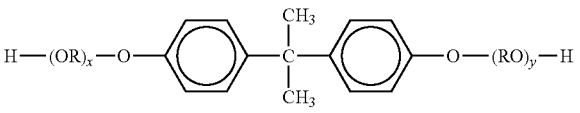

In the formula (A), R represents an ethylene group or a propylene group, "x" and "y" each represent an integer of 0 or more, and the average of x+y is 0 or more and 10 or less.

(B)

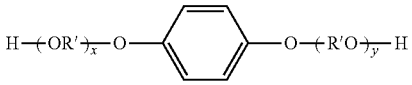

In the formula (B), R' represents an ethylene group, a 1-methylethylene group, or a 1,1-dimethylethylene group, and "x" and "y" each represent an integer of 0 or more, and the average of x+y is 0 or more and 10 or less.

As a trihydric or higher alcohol component, there are given, for example, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene. Of those, glycerol, trimethylolpropane, and pentaerythritol are preferably used.

Those dihydric alcohols and trihydric or higher alcohols may be used alone or in combination thereof.

The following polyvalent carboxylic acid monomers may each be used as a polyvalent carboxylic acid monomer to be used in the polyester.

As a divalent carboxylic acid component, there are given, for example, maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenylsuccinic acid, isododecenylsuccinic acid, n-dodecylsuccinic acid, isododecylsuccinic acid, n-octenylsuccinic acid, n-octylsuccinic acid, isooctenylsuccinic acid, and isooctylsuccinic acid, and anhydrides of those acids and lower alkyl esters thereof. Of those, maleic acid, fumaric acid, terephthalic acid, and n-dodecenylsuccinic acid are preferably used.

Examples of the trivalent or higher carboxylic acid, or the acid anhydride or lower alkyl ester thereof include 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, EMPOL trimer acid, and acid anhydrides thereof or lower alkyl esters thereof. Of those, 1,2,4-benzenetricarboxylic acid, i.e., trimellitic acid or a derivative thereof is particularly preferably used because trimellitic acid or the derivative thereof is available at low cost and its reaction can be easily controlled.

Those divalent carboxylic acids and trivalent or higher carboxylic acids may be used alone or in combination thereof.

The amorphous polyester may be a hybrid resin containing any other resin component as long as the resin contains the polyester as a main component. An example of the hybrid resin is a hybrid resin of the polyester and a vinyl-based resin. A method of obtaining a product of a reaction between the vinyl-based resin or a vinyl-based copolymerization unit and the polyester like the hybrid resin is preferably a method involving performing, in the presence of a polymer containing a monomer component that can react with each of the vinyl-based resin or the vinyl-based copolymerization unit and the polyester, the polymerization reaction of one, or each of both, of the resins.

Of the monomers each forming the polyester component, the monomer that can react with the vinyl-based copolymer is, for example, an unsaturated dicarboxylic acid, such as phthalic acid, maleic acid, citraconic acid, or itaconic acid, or an anhydride thereof. Of the monomers each forming the vinyl-based copolymer component, the monomer that can react with the polyester component is, for example, a monomer having a carboxyl group or a hydroxy group, or an acrylic acid or methacrylic acid ester.

In addition, in the toner according to one embodiment of the present disclosure, the toner particle may contain only the amorphous polyester as a binder resin, or may contain the amorphous polyester as a main component and contain any other resin as a subcomponent. Examples of such other resin include a phenol resin, a natural resin-modified phenol resin, a natural resin-modified maleic resin, an acrylic resin, a methacrylic resin, polyvinyl acetate, a silicone resin, a polyester, polyurethane, a polyamide, a furan resin, an epoxy resin, a xylene resin, polyvinyl butyral, a terpene resin, a coumarone-indene resin, and a petroleum-based resin.

In addition, the peak molecular weight of the amorphous polyester is preferably 8,000 or more and 13,000 or less from the viewpoints of the low-temperature fixability and hot offset resistance of the toner. In addition, the acid value of the amorphous polyester according to one embodiment of the present disclosure is preferably 20 mgKOH/g or less from the viewpoint of the charging stability of the toner under a high-temperature and high-humidity environment.

In addition, in the toner according to one embodiment of the present disclosure, the amorphous polyester in the toner particle may contain a macromolecular weight resin and a low-molecular weight resin. The content ratio (macromolecular weight resin/low-molecular weight resin) of the macromolecular weight resin to the low-molecular weight resin is preferably 10/90 or more and 60/40 or less on a mass basis from the viewpoints of the low-temperature fixability and the hot offset resistance.

The peak molecular weight of the macromolecular weight resin is preferably 10,000 or more and 20,000 or less from the viewpoint of the hot offset resistance. In addition, the acid value of the macromolecular weight resin is preferably 10 mgKOH/g or more and 30 mgKOH/g or less from the viewpoint of the charging stability under a high-temperature and high-humidity environment.

The peak molecular weight of the low-molecular weight resin is preferably 4,000 or more and 6,000 or less from the viewpoint of the low-temperature fixability. In addition, the acid value of the low-molecular weight resin is preferably 10 mgKOH/g or less from the viewpoint of the charging stability under a high-temperature and high-humidity environment.

<Wax (Release Agent)>

In the toner according to one embodiment of the present disclosure, the toner particle may contain a wax. The wax is preferably a polyolefin-based wax. The wax is more preferably a hydrocarbon-based wax because the hot offset resistance is further improved.

When the hydrocarbon-based wax is used, the polymer A is finely dispersed in the toner particle by an interaction between the wax and the polyolefin moiety of the polymer A, and hence the amount of a moiety improving hardness as the toner particle increases. As a result, a further improvement in durability of the toner can be achieved.

In one embodiment of the present disclosure, the wax is preferably used in an amount of 4 parts by mass or more and 12 parts by mass or less with respect to 100 parts by mass of the binder resin in the toner particle.

In addition, in an endothermic curve measured with a differential scanning calorimetry (DSC) apparatus at the time of temperature increase, the peak temperature of the highest endothermic peak of the wax is preferably 45° C. or more and 140° C. or less because both the storage stability and hot offset resistance of the toner can be achieved.

<Colorant>

As a colorant that may be incorporated into the toner, there are given, for example, the following colorants.

As a black colorant, there are given, for example: carbon black; and a colorant toned to a black color with a yellow colorant, a magenta colorant, and a cyan colorant. Although a pigment may be used alone as the colorant, a dye and the pigment are more preferably used in combination to improve the clarity of the colorant in terms of the quality of a full-color image.

As a pigment for magenta toner, there are given, for example: C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, 269, or 282; C.I. Pigment Violet 19; and C.I. Vat Red 1, 2, 10, 13, 15, 23, 29, or 35.

As a dye for magenta toner, there are given, for example: oil-soluble dyes, such as: C.I. Solvent Red 1, 3, 8, 23, 24, 25, 27, 30, 49, 81, 82, 83, 84, 100, 109, or 121; C.I. Disperse Red 9; C.I. Solvent Violet 8, 13, 14, 21, or 27; and C.I. Disperse Violet 1; and basic dyes, such as: C.I. Basic Red 1, 2, 9, 12, 13, 14, 15, 17, 18, 22, 23, 24, 27, 29, 32, 34, 35, 36, 37, 38, 39, or 40; and C.I. Basic Violet 1, 3, 7, 10, 14, 15, 21, 25, 26, 27, or 28.

As a pigment for cyan toner, there are given, for example: C.I. Pigment Blue 2, 3, 15:2, 15:3, 15:4, 16, or 17; C.I. Vat Blue 6; C.I. Acid Blue 45; and a copper phthalocyanine pigment in which a phthalocyanine skeleton is substituted by 1 to 5 phthalimidomethyl groups.

For example, C.I. Solvent Blue 70 is given as a dye for cyan toner.

As a pigment for yellow toner, there are given, for example: C.I. Pigment Yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181, or 185; and C.I. Vat Yellow 1, 3, or 20.

For example, C.I. Solvent Yellow 162 is given as a dye for yellow toner.

The colorant is preferably used in an amount of 0.1 part by mass or more and 30 parts by mass or less with respect to 100 parts by mass of the binder resin.

<Charge Control Agent>

A charge control agent may be incorporated into the toner as required. A known charge control agent may be utilized as the charge control agent to be incorporated into the toner. In particular, a metal compound of an aromatic carboxylic acid, which is colorless, provides a high charging speed of the toner, and can stably maintain a constant charge quantity, is preferred.

As a negative charge control agent, there are given a metal salicylate compound, a metal naphthoate compound, a metal dicarboxylate compound, a macro-molecular compound having a sulfonic acid or a carboxylic acid in a side chain thereof, a macro-molecular compound having a sulfonic acid salt or a sulfonic acid ester in a side chain thereof, a macro-molecular compound having a carboxylic acid salt or a carboxylic acid ester in a side chain thereof, a boron compound, a urea compound, a silicon compound, and a calixarene. As a positive charge control agent, there are given a quaternary ammonium salt, a macro-molecular compound having the quaternary ammonium salt in a side chain thereof, a guanidine compound, and an imidazole compound. The charge control agent may be internally added to the toner particle, or may be externally added thereto. The charge control agent is preferably added in an amount of 0.2 part by mass or more and 10 parts by mass or less with respect to 100 parts by mass of the binder resin.

<Crystalline Polyester>

In the toner according to one embodiment of the present disclosure, the toner particle may contain a crystalline polyester. When the toner particle contains the crystalline polyester, the low-temperature fixability of the toner is improved.

It is because of the following reason that the low-temperature fixability is improved by the crystalline polyester: the amorphous polyester and the crystalline polyester are made compatible with each other to widen an interval between the molecular chains of the amorphous polyester, and hence an intermolecular force therebetween is weakened; thus, the glass transition temperature (Tg) of the amorphous polyester is significantly reduced, and hence the melt viscosity thereof is reduced. Accordingly, the low-temperature fixability tends to be improved by improving compatibility between the amorphous polyester and the crystalline polyester. In addition, in order to improve the compatibility between the amorphous polyester and the crystalline polyester, the following method only needs to be adopted: the number of carbon atoms of an aliphatic diol and/or an aliphatic dicarboxylic acid serving as a monomer forming the crystalline polyester is reduced to improve a ratio of an ester group in the crystalline polyester, thereby improving the polarity of the crystalline polyester. Meanwhile, even in the toner in which the Tg of the amorphous polyester in the toner particle has significantly reduced, storage stability at the time of, for example, its use or transportation under a high-temperature and high-humidity environment needs to be secured. To that end, when the toner is exposed to such environment, the crystalline polyester in the toner particle that has been made compatible with the amorphous polyester needs to be recrystallized to return the Tg of the toner to the Tg of the amorphous polyester. Herein, when the ester group concentration of the crystalline polyester is high, and hence the compatibility between the amorphous polyester and the crystalline polyester is excessively high, it becomes difficult to recrystallize the crystalline polyester, and hence the storage stability of the toner reduces. The present inventors have made extensive investigations, and as a result, have found that both the low-temperature fixability and storage stability of the toner can be achieved by incorporating, into the toner particle, a crystalline polyester obtained by subjecting an aliphatic diol having 6 to 12 carbon atoms and an aliphatic dicarboxylic acid having 6 to 12 carbon atoms to a polycondensation reaction.

The aliphatic diol is not particularly limited, but is preferably a chain aliphatic diol, more preferably a straight-chain aliphatic diol. Examples thereof include ethylene glycol, diethylene glycol, triethylene glycol, 1,2-propylene glycol, 1,3-propylene glycol, dipropylene glycol, 1,4-butanediol, 1,4-butadiene glycol, trimethylene glycol, tetramethylene glycol, pentamethylene glycol, hexamethylene glycol, octamethylene glycol, nonamethylene glycol, decamethylene glycol, and neopentyl glycol. Of those, a straight-chain aliphatic and a,w-diols, such as ethylene glycol, diethylene glycol, 1,4-butanediol, and 1,6-hexanediol, are particularly preferred.

The aliphatic diol having 6 to 12 carbon atoms accounts for preferably 50 mass % or more, more preferably 70 mass % or more of a moiety derived from a diol in the crystalline polyester.

In one embodiment of the present disclosure, a polyhydric alcohol except the aliphatic diol may also be used as a monomer forming the crystalline polyester. As a dihydric alcohol monomer out of the polyhydric alcohols, there are given, for example: an aromatic alcohol such as polyoxyethylenated bisphenol A or polyoxypropylenated bisphenol A; and 1,4-cyclohexanedimethanol. In addition, as a trihydric or higher polyhydric alcohol monomer out of the polyhydric alcohol monomers, there are given, for example: an aromatic alcohol such as 1,3,5-trihydroxymethylbenzene; and an aliphatic alcohol such as pentaerythritol, dipentaerythritol, tripentaerythritol, 1,2,4-butanetriol, 1,2,5-pentanetriol, glycerin, 2-methylpropanetriol, 2-methyl-1,2,4-butanetriol, trimethylolethane, or trimethylolpropane.

Further, in one embodiment of the present disclosure, a monohydric alcohol may be used to such an extent that the characteristics of the crystalline polyester are not impaired. Examples of the monohydric alcohol include n-butanol, isobutanol, sec-butanol, n-hexanol, n-octanol, lauryl alcohol, 2-ethylhexanol, decanol, cyclohexanol, benzyl alcohol, and dodecyl alcohol.

Meanwhile, the aliphatic dicarboxylic acid is not particularly limited, but is preferably a chain aliphatic dicarboxylic acid, more preferably a straight-chain aliphatic dicarboxylic acid. Specific examples thereof include: oxalic acid, malonic acid, succinic acid, glutaric acid, adipic acid, pimelic acid, suberic acid, glutaconic acid, azelaic acid, sebacic acid, nonanedicarboxylic acid, decanedicarboxylic acid, undecanedicarboxylic acid, dodecanedicarboxylic acid, maleic acid, fumaric acid, mesaconic acid, citraconic acid, and itaconic acid; and products obtained by hydrolyzing acid anhydrides or lower alkyl esters thereof.

The aliphatic dicarboxylic acid having 6 to 12 carbon atoms accounts for preferably 50 mass % or more, more preferably 70 mass % or more of a moiety derived from a dicarboxylic acid in the crystalline polyester.

In one embodiment of the present disclosure, a polyvalent carboxylic acid except the aliphatic dicarboxylic acid may also be used as a monomer forming the crystalline polyester. As a divalent carboxylic acid out of the polyvalent carboxylic acids, there are given, for example: an aromatic carboxylic acid such as isophthalic acid or terephthalic acid; an aliphatic carboxylic acid such as n-dodecylsuccinic acid or n-dodecenylsuccinic acid; and an alicyclic carboxylic acid such as cyclohexanedicarboxylic acid. Examples of the divalent carboxylic acid also include acid anhydrides or lower alkyl esters thereof. In addition, as a trivalent or higher polyvalent carboxylic acid out of the polyvalent carboxylic acids, there are given, for example: an aromatic carboxylic acid such as 1,2,4-benzenetricarboxylic acid (trimellitic acid), 2,5,7-naphthalenetricarboxylic acid, 1,2,4-naphthalenetricarboxylic acid, or pyromellitic acid; and an aliphatic carboxylic acid such as 1,2,4-butanetricarboxylic acid, 1,2,5-hexanetricarboxylic acid, or 1,3-dicarboxy-2-methyl-2-methylenecarboxypropane. Examples of the trivalent or higher polyvalent carboxylic acid also include derivatives, such as acid anhydrides or lower alkyl esters, thereof.

Further, in one embodiment of the present disclosure, a monovalent carboxylic acid may be incorporated to such an extent that the characteristics of the crystalline polyester are not impaired. Examples of the monovalent carboxylic acid include benzoic acid, naphthalenecarboxylic acid, salicylic acid, 4-methylbenzoic acid, 3-methylbenzoic acid, phenoxyacetic acid, biphenylcarboxylic acid, acetic acid, propionic acid, butyric acid, octanoic acid, decanoic acid, dodecanoic acid, and stearic acid.

The crystalline polyester in one embodiment of the present disclosure may be produced in accordance with an ordinary polyester synthesis method. For example, the desired crystalline polyester may be obtained by: subjecting the carboxylic acid monomer and the alcohol monomer to an esterification reaction or an ester exchange reaction; and subjecting the resultant to a polycondensation reaction in accordance with an ordinary method under reduced pressure or while introducing a nitrogen gas.

The esterification or ester exchange reaction may be performed using a general esterification catalyst or ester exchange catalyst, such as sulfuric acid, titanium butoxide, dibutyltin oxide, manganese acetate, or magnesium acetate, as required.

In addition, the polycondensation reaction may be performed using a known catalyst, for example, an ordinary polymerization catalyst, such as titanium butoxide, dibutyltin oxide, tin acetate, zinc acetate, tin disulfide, antimony trioxide, or germanium dioxide. A polymerization temperature and a catalyst amount are not particularly limited, and may be appropriately determined.

In the esterification or ester exchange reaction, or the polycondensation reaction, all the raw materials may be collectively loaded for improving the strength of the crystalline polyester to be obtained. In addition, for example, the following method may be used for reducing the amount of a low-molecular weight component: the divalent monomers are caused to react with each other first, and then a monomer that is trivalent or more is added to, and caused to react with, the resultant.

The crystalline polyester is preferably incorporated in an amount of 1.0 part by mass or more and 15 parts by mass or less with respect to 100 parts by mass of the binder resin. When the amount of the crystalline polyester is small, a plasticizing effect is not sufficiently obtained, and hence the low-temperature fixability of the toner is not improved. In addition, when the crystalline polyester is added in an excessively large amount, the toner is liable to adsorb water, and hence its tinge stability is impaired.

From the viewpoint that the water adsorption is suppressed, the acid value of the crystalline polyester is preferably 2 mgKOH/g or more and 20 mgKOH/g or less.

<Inorganic Fine Particles>

It is important that the toner according to one embodiment of the present disclosure include the inorganic fine particles. The incorporation of the inorganic fine particles improves the mechanical strength of the toner particle, and hence can suppress the deterioration of the toner due to its long-term use. It is preferred that the inorganic fine particles be externally added. When the mechanical strength of the toner particle is improved, the liberation of the inorganic fine particles serving as an external additive due to the long-term use can be suppressed. The external additive is preferably inorganic fine particles, such as silica, titanium oxide, or aluminum oxide. The inorganic fine particles are preferably hydrophobized with a hydrophobizing agent, such as a silane compound, a silicone oil, or a mixture thereof.

For improving the fluidity of the toner, inorganic fine particles each having a specific surface area of 50 $m^2/g$ or more and 400 $m^2/g$ or less are preferred. In addition, for stabilizing the durability of the toner, inorganic fine particles each having a specific surface area of 10 $m^2/g$ or more and 50 $m^2/g$ or less are preferred. Inorganic fine particles each having a specific surface area that falls within the ranges may be used in combination in order that both the fluidity improvement and durability stabilization of the toner may be achieved.

The external additive is preferably used in an amount of 0.1 part by mass or more and 10.0 parts by mass or less with respect to 100 parts by mass of the toner particle. The toner particle and the external additive may be mixed with a known mixer, such as a Henschel mixer.

<Developer>

The toner according to one embodiment of the present disclosure may be used as a one-component developer, but is preferably mixed with a magnetic carrier and used as a two-component developer in order that dot reproducibility may be further improved. In addition, the case in which the toner is used as a two-component developer is also preferred from the viewpoint that a stable image may be obtained over a long time period.

A generally known carrier may be used as the magnetic carrier, and examples thereof include: magnetic materials, such as surface-oxidized iron powder or unoxidized iron powder, particles of metals, such as iron, lithium, calcium, magnesium, nickel, copper, zinc, cobalt, manganese, chromium, and rare earths, and particles of alloys or oxides of the metals, and ferrites thereof and a magnetic material-dispersed resin carrier (the so-called resin carrier) containing a magnetic material and a binder resin holding the magnetic material under a state in which the magnetic material is dispersed therein.

In the case where the toner according to one embodiment of the present disclosure is mixed with the magnetic carrier and used as a two-component developer, a satisfactory result is generally obtained when the ratio of the toner in the two-component developer is set to 2 mass % or more and 15 mass % or less, preferably 4 mass % or more and 13 mass % or less.

<Production Method>

The toner according to one embodiment of the present disclosure may be produced by a method including the following steps:

melt-kneading a resin composition containing an amorphous polyester and a polymer A to provide a kneaded product;

cooling the kneaded product to provide a cooled product;

pulverizing the cooled product to provide resin particles;

externally adding first inorganic fine particles to the resin particles to provide a toner particle before heat treatment;

treating the toner particle before heat treatment with hot air to provide a thermally treated toner particle; and externally adding second inorganic fine particles to the thermally treated toner particle to provide the toner.

In addition, when the thermally treated toner particle is obtained, treatment with hot air at 110° C. or more is performed.

In a raw material-mixing step of providing the resin composition, predetermined amounts of, for example, an amorphous polyester, and as required, a crystalline polyester and a hydrocarbon-based wax serving as toner raw materials are weighed, and the raw materials are blended and mixed.

A mixing apparatus is, for example, Henschel Mixer (manufactured by Nippon Coke & Engineering Co., Ltd.), Super Mixer (manufactured by Kawata MFG. Co., Ltd.), Ribocone (manufactured by Okawara MFG. Co., Ltd.), Nauta Mixer, Turbulizer, or Cyclomix (manufactured by Hosokawa Micron Corporation), Spiral Pin Mixer (manufactured by Pacific Machinery & Engineering Co., Ltd.), or Loedige Mixer (manufactured by Matsubo Corporation).

Further, the mixed toner raw materials are melt-kneaded in the melt-kneading step so that resins in the toner raw materials may be melted. A colorant or the like is added to the molten product to be dispersed therein. Thus, the resin composition serving as the kneaded product is obtained. A kneading apparatus is, for example, a TEM-type extruder (manufactured by Toshiba Machine Co., Ltd.), a TEX twin-screw kneader (manufactured by The Japan Steel Works, Ltd.), a PCM kneader (manufactured by Ikegai Ironworks Corporation), or Kneadex (manufactured by Mitsui Mining Co., Ltd.). However, a continuous kneading apparatus, such as a single-screw or twin-screw extruder, is preferred to a batch-type kneader because of, for example, the following superiority: the continuous kneading apparatus can continuously produce the resin composition.

After the melt-kneading, the resin composition is rolled with a twin-roll mill or the like, and is cooled through the cooling step of cooling the composition by water cooling or the like.

The resultant cooled product of the resin composition is then pulverized into a desired particle diameter in the pulverizing step. In the pulverizing step, first, the cooled product is coarsely pulverized with, for example, a crusher, a hammer mill, or a feather mill. Further, the coarsely pulverized product is finely pulverized with, for example, Kryptron System (manufactured by Kawasaki Heavy Industries, Ltd.) or Super Rotor (manufactured by Nisshin Engineering Inc.). Thus, toner fine particles serving as the resin particles are obtained.

The resultant toner fine particles are classified into powder particles for toner each having a desired particle diameter in a classifying step. A classifier is, for example, Turboplex, Faculty, TSP Separator, or TTSP Separator (manufactured by Hosokawa Micron Corporation), or Elbow-Jet (manufactured by Nittetsu Mining Co., Ltd.).

In the above-mentioned method of producing a toner, before the heat treatment step, the first inorganic fine particles are added to the resultant powder particles for toner to provide the toner particles before heat treatment. A method of adding the inorganic fine particles and the like to the powder particles for toner is as follows: predetermined amounts of the powder particles for toner and various known external additives are blended, and the blended materials are stirred and mixed by using, as an external addition machine, a high-speed stirring machine configured to apply a shear force to powder, such as Henschel Mixer or Mechano Hybrid (manufactured by Nippon Coke & Engineering Co., Ltd.), Super Mixer (manufactured by Kawata MFG. Co., Ltd.), or Nobilta (manufactured by Hosokawa Micron Corporation).

Subsequently, the resultant toner particles before heat treatment are subjected to sphering treatment with such a heat treatment apparatus as illustrated in FIGURE in the heat treatment step.

The toner particles before heat treatment supplied in a constant amount by a raw material constant amount supply unit 1 are introduced into an introduction pipe 3 by a compressed gas adjusted by a compressed gas-adjusting unit 2. The mixture that has passed the introduction pipe is uniformly dispersed by a conical protruded member 4 arranged on the vertical line at the central portion of the introduction pipe 3, is introduced into supply pipes 5 radially extending in eight directions, and is introduced into a treatment chamber 6 where heat treatment is performed.

At this time, the flow of the mixture supplied to the treatment chamber 6 is regulated by a regulating unit 9 for regulating the flow of a mixture, the unit being provided in the treatment chamber 6. Accordingly, the mixture supplied to the treatment chamber 6 is subjected to the heat treatment while swirling in the treatment chamber, and then the mixture is cooled.

Hot air for thermally treating the supplied mixture is supplied from a hot air supply unit 7, and the hot air is spirally swirled by a swirling member 13 for swirling the hot air to be introduced into the treatment chamber. With regard to the configuration of the swirling member 13 for swirling the hot air, the member has a plurality of blades, and can control the swirl of the hot air depending on the number of, and an angle between, the blades. The temperature of the hot air to be supplied into the treatment chamber at the outlet portion of the hot air supply unit 7 is preferably 110° C. or more and 300° C. or less. When the temperature at the outlet portion of the hot air supply unit 7 falls within the range, the toner particle can be uniformly subjected to sphering treatment while the fusion and coalescence of the toner particles due to excessive heating of the mixture are prevented.

The thermally treated toner particles that have been obtained by the heat treatment in the treatment chamber 6 are cooled by cold air supplied from a cold air supply unit 8. The temperature of the cold air is preferably from −20° C. to 30° C. When the temperature of the cold air falls within the range, the thermally treated toner particles can be efficiently cooled, and the fusion and coalescence of the thermally treated toner particles can be prevented without the inhibition of the uniform sphering treatment for the mixture. The absolute water content of the cold air is preferably 0.5 $g/m^3$ or more and 15.0 $g/m^3$ or less.

Next, the thermally treated toner particles that have been cooled are recovered by a recovery unit 10 positioned at the lower end of the treatment chamber. The configuration of the recovery unit is as follows: a blower (not shown) is arranged at the tip of the unit, and the particles are sucked and conveyed by the blower.

In addition, a powder particle supply port 14 is arranged so that the swirling direction of the supplied mixture and the swirling direction of the hot air may be identical to each other, and the recovery unit 10 of the surface treatment apparatus is arranged on the outer peripheral portion of the treatment chamber so that the swirling direction of a swirled powder particle for toner may be maintained. Further, the cold air supplied from the cold air supply unit 8 is configured so as to be supplied from the outer peripheral portion of the apparatus to the inner peripheral surface of the treatment chamber 6 from horizontal and tangential directions. The swirling direction of the toner to be supplied from the powder particle supply port 14, the swirling direction of the cold air supplied from the cold air supply unit 8, and the swirling direction of the hot air supplied from the hot air supply unit 7 are identical to one another. Accordingly, no turbulence occurs in the treatment chamber 6, a swirl flow in the apparatus is strengthened, a strong centrifugal force is applied to the toner, and the dispersibility of the toner is further improved, and hence thermally treated toner particles having a small number of coalesced particles and having a uniform shape can be obtained.

In the method of producing a toner according to one embodiment of the present disclosure, when coarse particles are present after the heat treatment, a step of removing the coarse particles through classification may be arranged as required. A classifier configured to remove the coarse particles is, for example, Turboplex, TSP Separator, or TTSP Separator (manufactured by Hosokawa Micron Corporation), or Elbow-Jet (manufactured by Nittetsu Mining Co., Ltd.).

Further, after the heat treatment, a sieving machine, such as Ultrasonic (manufactured by Koei Sangyo Co., Ltd.), Resonasieve or Gyro-Sifter (manufactured by Tokuju Corporation), Turbo Screener (manufactured by Turbo Kogyo Co., Ltd.), or Hi-Bolter (manufactured by Toyo Hitec Co., Ltd.), may be used as required for removing coarse particles and the like by sieving.

The heat treatment step according to one embodiment of the present disclosure may be performed after the fine pulverization, or may be performed after the classification.

The second inorganic fine particles are added to the thermally treated toner particle to obtain the toner. A method of adding the inorganic fine particles and the like to the thermally treated toner particle is as follows: predetermined amounts of the thermally treated toner particle and various known external additives are blended, and the blended materials are stirred and mixed by using, as an external addition machine, a high-speed stirring machine configured to apply a shear force to powder, such as Henschel Mixer or Mechano Hybrid (manufactured by Nippon Coke & Engineering Co., Ltd.), Super Mixer (manufactured by Kawata MFG. Co., Ltd.), or Nobilta (manufactured by Hosokawa Micron Corporation).

In the toner according to one embodiment of the present disclosure, the average circularity of the toner particles is preferably 0.960 or more, more preferably 0.965 or more. When the average circularity of the toner particles falls within the range, the transfer efficiency of the toner is improved.

Methods of measuring the various physical properties of the toner and the raw materials therefor are described below.

<Measurement of Glass Transition Temperature (Tg) of Resin>

The glass transition temperature of the resin to be used in one embodiment of the present disclosure is measured with a differential scanning calorimeter "Q1000" (manufactured by TA Instruments) in conformity with ASTM D3418-82.

The melting points of indium and zinc are used for the temperature correction of the detecting portion of the apparatus, and the heat of fusion of indium is used for the correction of a heat quantity.

Specifically, about 5 mg of the resin is precisely weighed and loaded into a pan made of aluminum, and then measurement is performed by using an empty pan made of aluminum as a reference in the measuring range of from 30° C. to 200° C. at a rate of temperature increase of 10° C./min. The temperature of the resin is increased to 180° C. once and held at the temperature for 10 minutes. Subsequently, the temperature is reduced to 30° C. and then increased again. In the second temperature increase process, a change in specific heat is obtained in the temperature range of from 30° C. to 100° C. The point of intersection of a line, which connects the midpoints of baselines before and after the appearance of the change in specific heat, and a differential thermal curve at this time is defined as the glass transition temperature (Tg) of the resin.

<Weight-Average Molecular Weight of Crystalline Polyester>

The weight-average molecular weight of the crystalline polyester in the toner according to one embodiment of the present disclosure is measured by gel permeation chromatography (GPC) as described below.

First, 0.03 g of the crystalline polyester is dispersed in 10 ml of o-dichlorobenzene to be dissolved therein. After that, the mixture is left to stand at 135° C. for 24 hours so that the resin may be dissolved in o-dichlorobenzene. Then, the resultant solution is filtered with a solvent-resistant membrane filter "Mysyori Disc" (manufactured by Tosoh Corporation) having a pore diameter of 0.2 μm to provide a sample solution. The measurement is performed by using the sample solution under the following conditions.

[Analysis Conditions]

Separation column: Shodex (TSK GMHHR-H HT20)×2
Column temperature: 135° C.
Mobile phase solvent: o-Dichlorobenzene
Mobile phase flow rate: 1.0 ml/min
Sample concentration: About 0.3%
Injection amount: 300 μl
Detector: A differential refractometer Shodex RI-71

In addition, at the time of the calculation of the molecular weight of the sample, a molecular weight calibration curve prepared with standard polystyrene resins (TSK Standard Polystyrenes F-850, F-450, F-288, F-128, F-80, F-40, F-20, F-10, F-4, F-2, F-1, A-5000, A-2500, A-1000, and A-500 manufactured by Tosoh Corporation) is used.

<Measurement of Molecular Weight of Resin by GPC>

The molecular weight distribution of the THF soluble matter of the resin in the toner according to one embodiment of the present disclosure is measured by gel permeation chromatography (GPC) as described below.

First, the toner is dissolved in tetrahydrofuran (THF) at room temperature over 24 hours. Then, the resultant solution is filtered with a solvent-resistant membrane filter "Mysho-ridisk" (manufactured by Tosoh Corporation) having a pore diameter of 0.2 μm to provide a sample solution. The concentration of a THF-soluble component in the sample solution is adjusted to about 0.8 mass %. Measurement is performed with the sample solution under the following conditions.

Apparatus: HLC 8120 GPC (detector: RI) (manufactured by Tosoh Corporation)
Column: Septuplicate of Shodex KF-801, 802, 803, 804, 805, 806, and 807 (manufactured by Showa Denko K. K.)
Eluent: tetrahydrofuran (THF)
Flow rate: 1.0 ml/min
Oven temperature: 40.0° C.
Sample injection amount: 0.10 ml At the time of the calculation of the molecular weight of the sample, a molecular weight calibration curve prepared with standard polystyrene resins (e.g., product names "TSK Standard Polystyrenes F-850, F-450, F-288, F-128, F-80, F-40, F-20, F-10, F-4, F-2, F-1, A-5000, A-2500, A-1000, and A-500" manufactured by Tosoh Corporation) is used.

<Method of Measuring Softening Point of Resin>

The softening point of the resin in the toner according to one embodiment of the present disclosure is measured through use of a constant-pressure extrusion system capillary rheometer "flow characteristic-evaluating apparatus Flow Tester CFT-500D" (manufactured by Shimadzu Corporation) in accordance with the manual attached to the apparatus. In this apparatus, a measurement sample filled in a cylinder is increased in temperature to be melted while a predetermined load is applied to the measurement sample with a piston from above, and the melted measurement sample is extruded from a die in a bottom part of the cylinder. At this time, a flow curve representing a relationship between a piston descent amount and the temperature can be obtained.

In one embodiment of the present disclosure, a "melting temperature in a ½ method" described in the manual attached to the "flow characteristic-evaluating apparatus Flow Tester CFT-500D" is defined as a softening point. The melting temperature in the ½ method is calculated as described below. First, ½ of a difference between a descent amount Smax of the piston at a time when the outflow is finished and a descent amount Smin of the piston at a time when the outflow is started is determined (The ½ of the difference is defined as X. X=(Smax−Smin)/2). Then, the temperature in the flow curve when the descent amount of the piston reaches X in the flow curve is the melting temperature in the ½ method.

The measurement sample is obtained by subjecting about 1.0 g of the resin to compression molding for about 60 seconds under about 10 MPa through use of a tablet compressing machine (for example, NT-100H, manufactured by NPa SYSTEM Co., Ltd.) under an environment of 25° C. to form the resin into a cylindrical shape having a diameter of about 8 mm.

The measurement conditions of the CFT-500D are as described below.

Test mode: heating method
Starting temperature: 50° C.
Reached temperature: 200° C.
Measurement interval: 1.0° C.
Rate of temperature increase: 4.0° C./min
Piston sectional area: 1.000 $cm^2$
Test load (piston load): 10.0 kgf (0.9807 MPa)
Preheating time: 300 seconds
Diameter of hole of die: 1.0 mm
Length of die: 1.0 mm <Method of Measuring Weight-Average Particle Diameter (D4) of Toner Particles>

The weight-average particle diameter (D4) of the toner particles is measured with the number of effective measurement channels of 25,000 by using a precision particle size distribution-measuring apparatus based on a pore electrical resistance method provided with a 100-micrometer aperture tube "Coulter Counter Multisizer 3" (trademark, manufactured by Beckman Coulter, Inc.) and dedicated software included therewith "Beckman Coulter Multisizer 3 Version 3.51" (manufactured by Beckman Coulter, Inc.) for setting measurement conditions and analyzing measurement data. Then, the measurement data is analyzed to calculate the diameter.

An electrolyte aqueous solution prepared by dissolving guaranteed sodium chloride in ion-exchanged water so as to have a concentration of about 1 mass %, such as "ISOTON II" (manufactured by Beckman Coulter, Inc.), may be used in the measurement.

The dedicated software is set as described below prior to the measurement and the analysis.

In the "change standard measurement method (SOM)" screen of the dedicated software, the total count number of a control mode is set to 50,000 particles, the number of times of measurement is set to 1, and a value obtained by using "standard particles each having a particle diameter of 10.0 μm" (manufactured by Beckman Coulter, Inc.) is set as a Kd value. A threshold and a noise level are automatically set by pressing a threshold/noise level measurement button. In addition, a current is set to 1,600 μA, a gain is set to 2, and an electrolyte solution is set to ISOTON II, and a check mark is placed in a check box as to whether the aperture tube is flushed after the measurement.

In the "setting for conversion from pulse to particle diameter" screen of the dedicated software, a bin interval is set to a logarithmic particle diameter, the number of particle diameter bins is set to 256, and a particle diameter range is set to the range of 2 or more and 60 μm or less.

A specific measurement method is as described below.

(1) About 200 ml of the electrolyte aqueous solution is charged into a 250-milliliter round-bottom beaker made of glass dedicated for the Multisizer 3. The beaker is set in a sample stand, and the electrolyte aqueous solution in the beaker is stirred with a stirrer rod at 24 rotations/sec in a counterclockwise direction. Then, dirt and bubbles in the aperture tube are removed by the "aperture flush" function of the analytical software.

(2) About 30 ml of the electrolyte aqueous solution is charged into a 100-milliliter flat-bottom beaker made of glass. About 0.3 ml of a diluted solution prepared by diluting "Contaminon N" (a 10 mass % aqueous solution of a neutral detergent for washing a precision measuring device formed of a nonionic surfactant, an anionic surfactant, and an organic builder and having a pH of 7 manufactured by Wako Pure Chemical Industries, Ltd.) with ion-exchanged water by three mass fold is added as a dispersant to the electrolyte aqueous solution.

(3) A predetermined amount of ion-exchanged water is charged into the water tank of an ultrasonic dispersing unit "Ultrasonic Dispension System Tetora 150" (manufactured by Nikkaki Bios Co., Ltd.) having an electrical output of 120 W in which two oscillators each having an oscillatory frequency of 50 kHz are built so as to be out of phase by 180°. About 2 ml of the Contaminon N is charged into the water tank.

(4) The beaker in the section (2) is set in the beaker fixing hole of the ultrasonic dispersing unit, and the ultrasonic dispersing unit is operated. Then, the height position of the beaker is adjusted in order that the liquid level of the electrolyte aqueous solution in the beaker may resonate with an ultrasonic wave from the ultrasonic dispersing unit to the fullest extent possible.

(5) About 10 mg of toner is gradually added to and dispersed in the electrolyte aqueous solution in the beaker in the section (4) under a state in which the electrolyte aqueous solution is irradiated with the ultrasonic wave. Then, the ultrasonic dispersion treatment is continued for an additional 60 seconds. The temperature of water in the water tank is appropriately adjusted to 10° C. or more and 40° C. or less in the ultrasonic dispersion.

(6) The electrolyte aqueous solution in the section (5) in which the toner has been dispersed is dropped with a pipette to the round-bottom beaker in the section (1) placed in the sample stand, and the concentration of the toner to be measured is adjusted to about 5%. Then, measurement is performed until the particle diameters of 50,000 particles are measured.

(7) The measurement data is analyzed with the dedicated software included with the apparatus, and the weight-average particle diameter (D4) is calculated. An "average diameter" on the "analysis/volume statistics (arithmetic average)" screen of the dedicated software when the dedicated software is set to show a graph in a vol % unit is the weight-average particle diameter (D4).

EXAMPLES

In the following Examples, the term "part(s)" means "part(s) by mass."

Production Example of Amorphous Polyester L

Polyoxypropylene(2.2)-2,2-bis(4-hydroxyphenyl)propane: 72.0 parts (0.20 mol; 100.0 mol % with respect to the total number of moles of polyhydric alcohols)

Terephthalic acid: 28.0 parts (0.17 mol; 100.0 mol % with respect to the total number of moles of polyvalent carboxylic acids)

Tin 2-ethylhexanoate (esterification catalyst): 0.5 part

The above-mentioned materials were weighed and loaded into a reaction vessel with a cooling tube, a stirrer, a nitrogen-introducing tube, and a thermocouple. Next, the flask was purged with a nitrogen gas. After that, a temperature in the flask was gradually increased while the mixture was stirred. The mixture was subjected to a reaction for 4 hours while being stirred at a temperature of 200° C.

Further, a pressure in the reaction vessel was reduced to 8.3 kPa and maintained at the pressure for 1 hour. After that, the temperature was cooled to 180° C. and the pressure was returned to atmospheric pressure.

Trimellitic anhydride: 1.3 parts (0.01 mol; 4.0 mol % with respect to the total number of moles of polyvalent carboxylic acids)

tert-Butylcatechol (polymerization inhibitor): 0.1 part

After that, the above-mentioned materials were added to the resultant, and the mixture was subjected to a reaction for 1 hour while a pressure in the reaction vessel was reduced to 8.3 kPa and a temperature therein was maintained at 180° C. It was confirmed that the softening point of the reaction product measured in accordance with ASTM D36-86 reached 90° C., and then the temperature was reduced to stop the reaction. Thus, an amorphous polyester L was obtained. The resultant amorphous polyester L had a number-average molecular weight of 2,300, a weight-average molecular weight of 6,300, and a glass transition temperature Tg of 57.2° C.

Production Example of Amorphous Polyester H

Polyoxypropylene(2.2)-2,2-bis(4-hydroxyphenyl)propane: 72.3 parts (0.20 mol; 100.0 mol % with respect to the total number of moles of a polyhydric alcohol)

Terephthalic acid: 18.3 parts (0.11 mol; 65.0 mol % with respect to the total number of moles of polyvalent carboxylic acids)

Fumaric acid: 2.9 parts (0.03 mol; 15.0 mol % with respect to the total number of moles of polyvalent carboxylic acids)

Tin 2-ethylhexanoate (esterification catalyst): 0.5 part

The above-mentioned materials were weighed and loaded into a reaction vessel with a cooling tube, a stirrer, a nitrogen-introducing tube, and a thermocouple. Next, the reaction vessel was purged with a nitrogen gas, and then a temperature therein was gradually increased while the materials were stirred. The materials were subjected to a reaction for 2 hours while being stirred at a temperature of 200° C.

Further, a pressure in the reaction vessel was reduced to 8.3 kPa and maintained at the pressure for 1 hour. After that, the temperature was cooled to 180° C. and the pressure was returned to atmospheric pressure.

Trimellitic anhydride: 6.5 parts (0.03 mol; 20.0 mol % with respect to the total number of moles of the polyvalent carboxylic acids)

tert-Butylcatechol (polymerization inhibitor): 0.1 part

After that, the above-mentioned materials were added to the resultant, and the mixture was subjected to a reaction for 15 hours while a pressure in the reaction vessel was reduced to 8.3 kPa and a temperature therein was maintained at 160° C. It was confirmed that the softening point of the reaction product measured in accordance with ASTM D36-86 reached 137° C., and then the temperature was reduced to stop the reaction. Thus, an amorphous polyester H was obtained. The resultant amorphous polyester H had a number-average molecular weight of 3,600, a weight-average molecular weight of 36,500, and a glass transition temperature Tg of 55.5° C.

Production Example of Crystalline Polyester A 1,6-Hexanediol: 34.5 parts (0.29 mol; 100.0 mol % with respect to the total number of moles of a polyhydric alcohol)

Dodecanedioic acid: 65.5 parts (0.28 mol; 100.0 mol % with respect to the total number of moles of a polyvalent carboxylic acid)

Tin 2-ethylhexanoate: 0.5 part

The above-mentioned materials were weighed and loaded into a reaction vessel with a cooling tube, a stirrer, a nitrogen-introducing tube, and a thermocouple. The flask was purged with a nitrogen gas, and then a temperature therein was gradually increased while the materials were stirred. The materials were subjected to a reaction for 3 hours while being stirred at a temperature of 140° C.

Next, the mixture was subjected to a reaction for 4 hours while a pressure in the reaction vessel was reduced to 8.3 kPa and a temperature therein was maintained at 200° C.

Further, the pressure in the reaction vessel was gradually released to be returned to normal pressure. After that, 7.0 mol % of lauric acid with respect to 100.0 mol % of the raw material monomers was added to the resultant, and the mixture was subjected to a reaction under normal pressure at 200° C. for 2 hours.

After that, the pressure in the reaction vessel was reduced to 5 kPa or less again, and the resultant was subjected to a reaction at 200° C. for 3 hours to provide a crystalline polyester A. The resultant crystalline polyester A had a number-average molecular weight of 2,600, a weight-average molecular weight of 23,800, and a melting point of 71.6° C.

Production Example of Polymer A-1

The following materials were mixed to prepare a mixed solution.

| | |
|---|---|
| Styrene | 68.0 parts |
| Methacrylic acid | 5.0 parts |
| Cyclohexyl methacrylate | 5.0 parts |
| Butyl acrylate | 12.0 parts |
| Xylene | 250 parts |

The following materials were separately loaded into an autoclave reaction vessel including a temperature gauge and a stirring machine so that the polypropylene was sufficiently dissolved in xylene. The reaction vessel was purged with nitrogen, and then the mixed solution was dropped to the solution at 180° C. over 3 hours to perform polymerization. Further, 15.0 parts of aluminum hydroxide was dropped to the resultant, and the mixture was held at the temperature for 30 minutes, followed by desolvation. Thus, a polymer A-1 was obtained. The polymer A-1 had a structure including a graft copolymer of the polypropylene and a vinyl-based polymer unit having a carboxylate anion group, and an aluminum ion.

| | |
|---|---|
| Xylene | 300 parts |
| Polypropylene (melting point: 81° C.) | 10 parts |

Production Examples of Polymers A-2 to A-8

Polymers A-2 to A-7 were each obtained by performing the same operation as that in the production example of the polymer A-1 except that the addition amount of the carboxylate anion group source, and the kind and addition amount of the metal ion source were changed as shown in Table 1.

With regard to the production of a polymer A-8, the same operation as that in the production example of the polymer A-1 was performed except that the production was performed without the addition of methacrylic acid and the metal ion.

The polymers A-2 to A-6 each had a structure including a graft copolymer of the polypropylene and a vinyl-based polymer unit having a carboxylate anion group, and a metal ion.

TABLE 1

| | Carboxylate anion group source | | Metal ion source | | Ratio with respect to mass of polymer A | | | Weight-average molecular |
|---|---|---|---|---|---|---|---|---|
| Polymer No. | Kind | Addition amount (part(s)) | Kind | Addition amount (part(s)) | Polyolefin unit (mass %) | Monomer unit having carboxylate anion group (mass %) | Metal ion (mass %) | weight of graft copolymer |
| Polymer A-1 | Methacrylic acid | 5 | $Al(OH)_3$ | 15 | 9.2 | 4.6 | 7.7 | 30,600 |
| Polymer A-2 | Methacrylic acid | 2 | $Al(OH)_3$ | 7.5 | 9.8 | 2.0 | 4.2 | 29,500 |
| Polymer A-3 | Methacrylic acid | 10 | $Al(OH)_3$ | 30 | 8.1 | 8.1 | 13.8 | 31,500 |
| Polymer A-4 | Methacrylic acid | 1 | $Al(OH)_3$ | 3 | 10.2 | 1.0 | 1.7 | 29,400 |
| Polymer A-5 | Methacrylic acid | 15 | $Al(OH)_3$ | 45 | 7.3 | 10.9 | 18.6 | 30,500 |
| Polymer A-6 | Methacrylic acid | 5 | $Ca(OH)_2$ | 10 | 9.4 | 4.7 | 5.1 | 30,750 |
| Polymer A-7 | Methacrylic acid | 5 | NaOH | 5 | 9.7 | 4.9 | 2.8 | 29,800 |
| Polymer A-8 | — | — | — | — | 10.5 | 0.0 | 0.0 | 28,500 |

Production Example of Toner 1

Amorphous polyester L: 60.0 parts
Amorphous polyester H: 40.0 parts
Crystalline polyester A: 5.0 parts
Polymer A-1: 11.3 parts
Fischer-Tropsch wax (hydrocarbon wax, peak temperature of highest endothermic peak: 90° C.): 8.0 parts
C.I. Pigment Blue 15:3: 7.0 parts
Aluminum 3,5-di-t-butylsalicylate compound (BONTRON E88, manufactured by Orient Chemical Industries Co., Ltd.): 0.3 part The above-mentioned materials were mixed with a Henschel mixer (Model FM-75 manufactured by Mitsui Mining Co., Ltd.) at a number of rotations of 20 $s^{-1}$ for a time of rotation of 5 min, and thereafter, the mixture was kneaded with a twin-screw kneader (PCM-30 manufactured by Ikegai Corp.). A barrel temperature at the time of the kneading was set so that the outlet temperature of the kneaded product became 120° C. The outlet temperature of the kneaded product was directly measured with a compact temperature gauge (HA-200E, manufactured by Anritsu Meter Co., Ltd.).

The kneaded product thus obtained was cooled and coarsely pulverized with a hammer mill to 1 mm or less to provide a coarsely pulverized product. The coarsely pulverized product thus obtained was finely pulverized with a mechanical pulverizer (T-250 manufactured by Turbo Kogyo Co., Ltd.). Further, the finely pulverized product was classified with Faculty F-300 (manufactured by Hosokawa Micron Corporation) to provide toner particles 1. The operating conditions of Faculty F-300 were as follows: the number of rotations of a classification rotor was set to 130 $s^{-1}$ and the number of rotations of a dispersion rotor was set to 120 $s^{-1}$.

Five point zero parts of silica fine particles (BET: 30 $m^2/g$) were added to 100 parts of the resultant toner particles 1, and the particles were mixed with a Henschel mixer (MODEL FM-75, manufactured by Mitsui Mining Co., Ltd.) at a number of revolutions of 30 $s^{-1}$ for a time of revolution of 10 min. After that, the mixture was thermally treated with a surface treatment apparatus illustrated in FIGURE to provide the thermally treated particles of the toner particles 1. The apparatus was operated under the conditions of a feeding amount of 5 kg/hr, a hot air temperature C of 150° C., a hot air flow rate of 6 $m^3$/min, a cold air temperature E of −5° C., a cold air flow rate of 4 $m^3$/min, a blower flow rate of 20 $m^3$/min, and an injection air flow rate of 1 $m^3$/min.

One hundred parts of the resultant thermally treated particles were mixed with 1.0 part by mass of hydrophobic silica (BET: 200 $m^2/g$) and 1.0 part of titanium oxide fine particles subjected to surface treatment with isobutyl trimethoxysilane (BET: 80 $m^2/g$) by using a Henschel mixer (MODEL FM-75, manufactured by Mitsui Mining Co., Ltd.) at a number of revolutions of 30 $s^{-1}$ for a time of revolution of 10 min. Thus, a toner 1 was obtained. The resultant toner 1 had a weight-average particle diameter D4 of 6.5 μm.

Production Examples of Toners 2 to 18

Toners 2 to 18 were each obtained in the same manner as in the production example of the toner 1 except that the kind of the polymer A, the wax amount, and the presence or absence of the heat treatment step were changed as shown in Table 2.

TABLE 2

| Toner No. | Polymer A Kind | Polymer A Content (mass %) | Wax content per 100 parts by mass of binder resin (part(s) by mass) | Heat sphering treatment |
|---|---|---|---|---|
| Toner 1 | Polymer A-1 | 8.0 | 8.0 | Present |
| Toner 2 | Polymer A-1 | 8.0 | 8.0 | Absent |
| Toner 3 | Polymer A-1 | 8.0 | 8.0 | Present |
| Toner 4 | Polymer A-1 | 8.0 | 8.0 | Present |
| Toner 5 | Polymer A-1 | 8.0 | 8.0 | Present |
| Toner 6 | Polymer A-1 | 8.0 | 8.0 | Present |
| Toner 7 | Polymer A-1 | 8.0 | 6.0 | Present |
| Toner 8 | Polymer A-1 | 8.0 | 10.0 | Present |
| Toner 9 | Polymer A-1 | 8.0 | 2.0 | Present |
| Toner 10 | Polymer A-1 | 8.0 | 14.0 | Present |
| Toner 11 | Polymer A-2 | 8.0 | 8.0 | Present |
| Toner 12 | Polymer A-3 | 8.0 | 8.0 | Present |
| Toner 13 | Polymer A-4 | 8.0 | 8.0 | Present |
| Toner 14 | Polymer A-5 | 8.0 | 8.0 | Present |
| Toner 15 | Polymer A-6 | 8.0 | 8.0 | Present |
| Toner 16 | Polymer A-7 | 8.0 | 8.0 | Absent |
| Toner 17 | Polymer A-8 | 8.0 | 2.0 | Absent |
| Toner 18 | — | 8.0 | 2.0 | Absent |

Production Example of Magnetic Core Particles 1

Step 1 (Weighing/mixing Step):

| | |
|---|---|
| $Fe_2O_3$ | 62.7 parts |
| $MnCO_3$ | 29.5 parts |
| $Mg(OH)_2$ | 6.8 parts |
| $SrCO_3$ | 1.0 part |

Ferrite raw materials were weighed so that the above-mentioned materials had the above-mentioned composition ratio. After that, the materials were pulverized and mixed with a dry vibrating mill using stainless-steel beads each having a diameter of ⅛ inch for 5 hours.

Step 2 (Pre-Calcining Step):

The resultant pulverized product was turned into a square pellet about 1 mm on a side with a roller compacter. Coarse powder was removed from the pellet with a vibrating sieve having an aperture of 3 mm. Then, fine powder was removed therefrom with a vibrating sieve having an aperture of 0.5 mm. After that, the remainder was calcined under a nitrogen atmosphere (oxygen concentration: 0.01 vol %) with a burner-type calcining furnace at a temperature of 1,000° C. for 4 hours to produce a pre-calcined ferrite. The composition of the resultant pre-calcined ferrite is as described below.

$(MnO)_a(MgO)_b(SrO)_c(Fe_2O_3)_d$ where a=0.257, b=0.117, c=0.007, and d=0.393.

Step 3 (Pulverizing Step):

The pre-calcined ferrite was pulverized with a crusher into pieces each having a size of about 0.3 mm. After that, 30 parts by mass of water with respect to 100 parts of the pre-calcined ferrite was added to the pieces, and then the mixture was pulverized with a wet ball mill using zirconia beads each having a diameter of ⅛ inch for 1 hour. The resultant slurry was pulverized with a wet ball mill using alumina beads each having a diameter of 1/16 inch for 4 hours. Thus, a ferrite slurry (finely pulverized product of the pre-calcined ferrite) was obtained.

Step 4 (Granulating Step):

One point zero part by mass of ammonium polycarboxylate serving as a dispersant and 2.0 parts of polyvinyl alcohol serving as a binder with respect to 100 parts of the pre-calcined ferrite were added to the ferrite slurry, and then the mixture was granulated into spherical particles with a spray drier (manufactured by Ohkawara Kakohki Co., Ltd.). The particle sizes of the resultant particles were adjusted, and then the dispersant and the binder serving as organic components were removed by heating the particles with a rotary kiln at 650° C. for 2 hours.

Step 5 (Calcining Step):

In order for a calcining atmosphere to be controlled, the temperature of the remainder was increased from room temperature to a temperature of 1,300° C. in an electric furnace under a nitrogen atmosphere (having an oxygen concentration of 1.00 vol %) in 2 hours, and then the remainder was calcined at a temperature of 1,150° C. for 4 hours. After that, the temperature of the calcined product was decreased to a temperature of 60° C. over 4 hours and the nitrogen atmosphere was returned to the air. When its temperature became 40° C. or less, the calcined product was taken out.

Step 6 (Sorting Step):

After an agglomerated particle had been shredded, a low-magnetic force product was discarded by magnetic separation, and coarse particles were removed by sieving with a sieve having an aperture of 250 μm. Thus, magnetic core particles 1 having a 50% particle diameter (D50) on a volume distribution basis of 37.0 μm were obtained.

<Preparation of Coating Resin 1>

| | |
|---|---|
| Cyclohexyl methacrylate | 26.8 mass % |
| Methyl methacrylate | 0.2 mass % |
| Methyl methacrylate macromonomer (macromonomer having a methacryloyl group at one terminal and having a weight-average molecular weight of 5,000) | 8.4 mass % |
| Toluene | 31.3 mass % |
| Methyl ethyl ketone | 31.3 mass % |
| Azobisisobutyronitrile | 2.0 mass % |

Of the above-mentioned materials, cyclohexyl methacrylate, methyl methacrylate, the methyl methacrylate macromonomer, toluene, and methyl ethyl ketone were added to a four-necked separable flask with a reflux condenser, a temperature gauge, a nitrogen-introducing tube, and a stirrer. Then, a nitrogen gas was introduced into the flask to sufficiently establish a nitrogen atmosphere. After that, the temperature of the mixture was increased to 80° C., azobisisobutyronitrile was added to the mixture, and the whole was polymerized by being refluxed for 5 hours. Hexane was injected into the resultant reaction product to precipitate and deposit a copolymer, and then the precipitate was separated by filtration. After that, the precipitate was vacuum-dried to provide a coating resin 1.

Thirty parts of the resultant coating resin 1 was dissolved in 40 parts of toluene and 30 parts of methyl ethyl ketone. Thus, a polymer solution 1 (solid content: 30 mass %) was obtained.

<Preparation of Coating Resin Solution 1>

| | |
|---|---|
| Polymer solution 1 (resin solid content concentration: 30%) | 33.3 mass % |
| Toluene | 66.4 mass % |
| Carbon black (Regal 330 manufactured by Cabot Corporation) (primary particle diameter: 25 nm, nitrogen adsorption specific surface area: 94 $m^2/g$, DBP oil absorption: 75 ml/100 g) | 0.3 mass % |

The above-mentioned materials were dispersed with a paint shaker using zirconia beads each having a diameter of 0.5 mm for 1 hour. The resultant dispersion liquid was filtered through a 5.0-micrometer membrane filter. Thus, a coating resin solution 1 was obtained.

Production Example of Magnetic Carrier 1

The coating resin solution 1 was charged into a vacuum deaeration-type kneader maintained at normal temperature so that its amount in terms of a resin component was 2.5 parts by mass with respect to 100 parts by mass of the magnetic core particles 1. After having been charged, the solution was stirred at a rotational speed of 30 rpm for 15 minutes. After a certain amount (80 mass %) or more of the solvent had been volatilized, the temperature in the kneader was increased to 80° C. while the remaining contents were mixed under reduced pressure. Toluene was removed by distillation over 2 hours and then the residue was cooled. A low-magnetic force product was separated from the resultant magnetic carrier by magnetic separation and then the remainder was passed through a sieve having an aperture of 70 μm. After that, the resultant was classified with an air classifier. Thus, a magnetic carrier 1 having a 50% particle diameter (D50) on a volume distribution basis of 38.2 μm was obtained.

Production Example of Two-component Developer 1

Eight point zero parts of the toner 1 was added to 92.0 parts of the magnetic carrier 1, and the contents were mixed with a V-type mixer (V-20 manufactured by Seishin Enterprise Co., Ltd.) to provide a two-component developer 1.

Production Examples of Two-component Developers 2 to 18

Two-component developers 2 to 18 were each obtained in the same manner as in the production example of the two-component developer 1 except that the toner was changed as shown in Table 3.

Example 1

A reconstructed machine of a printer for digital commercial printing "imageRUNNER ADVANCE C9075 PRO" manufactured by Canon Inc. was used as an image-forming apparatus. The two-component developer 1 was loaded into a developing unit at the cyan position of the reconstructed machine, and an image was formed so that a toner laid-on level on paper became a desired value, followed by an evaluation to be described later. Reconstructed points are as follows: the apparatus was changed so that its fixation temperature and process speed could be freely set. At the time of the image output evaluation, the DC voltage Vuc of a developer carrier of the reconstructed machine, the charging voltage VD of an electrostatic latent image-bearing member thereof, and the laser power thereof were adjusted so that the toner laid-on level of an FFh image (solid image) on the paper became 0.35 $mg/cm^2$. FFh is a value obtained by representing 256 gradations in hexadecimal notation; 00h represents the first gradation (white portion) of the 256 gradations, and FFh represents the 256th gradation (solid portion) of the 256 gradations.

The evaluation was performed based on the following evaluation method. The result is shown in Table 3.

<Evaluation of Toner Durability>

Paper: CS-680 (68.0 g/$m^2$)

(sold from Canon Marketing Japan Inc.)

Toner laid-on level on paper: 0.35 mg/$cm^2$ (FFh image)

Test environment: High-temperature and high-humidity environment (temperature of 30° C./humidity of 80% RH (hereinafter referred to as "H/H"))

As an endurance image output test, output on 10,000 sheets of the A4 paper was performed by using a band chart for outputting an FFh image having an image ratio of 0.1%. After that, an image having an area of 10 $cm^2$ was arranged at the center of the A4 paper, and its image density after the output was measured. Subsequently, output on 1,000 sheets of the A4 paper was performed by using a band chart for outputting an FFh image having an image ratio of 40.0%. After that, an image having an area of 10 $cm^2$ was arranged at the center of the A4 paper, and its image density after the output was measured. A difference between the densities of the two evaluation images was evaluated by the following criteria. The image densities were measured with a spectral densitometer "504 Spectral Densitometer" (manufactured by X-Rite Inc.). The result is shown in Table 3.

<Evaluation Criteria>

A: The density difference is less than 0.10 (extremely excellent).

B: The density difference is 0.10 or more and less than 0.15 (satisfactory).

C: The density difference is 0.15 or more and less than 0.25 (level at which no problem occurs in one embodiment of the present disclosure).

D: The density difference is 0.25 or more (unacceptable in one embodiment of the present disclosure).

Examples 2 to 15 and Comparative Examples 1 to 3

Evaluations were performed in the same manner as in Example 1 except that the two-component developers 2 to 18 were used. The results of the evaluations are shown in Table 3.

TABLE 3

| | Two-component developer No. | Toner No. | Evaluation | |
|---|---|---|---|---|
| | | | Evaluation | Durability |
| Example 1 | Two-component developer 1 | Toner 1 | A | 0.02 |
| Example 2 | Two-component developer 2 | Toner 2 | B | 0.12 |
| Example 3 | Two-component developer 3 | Toner 3 | A | 0.03 |
| Example 4 | Two-component developer 4 | Toner 4 | A | 0.04 |
| Example 5 | Two-component developer 5 | Toner 5 | B | 0.12 |
| Example 6 | Two-component developer 6 | Toner 6 | B | 0.12 |
| Example 7 | Two-component developer 7 | Toner 7 | B | 0.13 |
| Example 8 | Two-component developer 8 | Toner 8 | B | 0.13 |
| Example 9 | Two-component developer 9 | Toner 9 | C | 0.16 |
| Example 10 | Two-component developer 10 | Toner 10 | C | 0.17 |
| Example 11 | Two-component developer 11 | Toner 11 | B | 0.13 |
| Example 12 | Two-component developer 12 | Toner 12 | B | 0.14 |
| Example 13 | Two-component developer 13 | Toner 13 | C | 0.18 |
| Example 14 | Two-component developer 14 | Toner 14 | C | 0.21 |
| Example 15 | Two-component developer 15 | Toner 15 | C | 0.24 |
| Comparative Example 1 | Two-component developer 16 | Toner 16 | D | 0.27 |
| Comparative Example 2 | Two-component developer 17 | Toner 17 | D | 0.34 |
| Comparative Example 3 | Two-component developer 18 | Toner 18 | D | 0.36 |

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-163853, filed Aug. 31, 2018, which is hereby incorporated by reference herein in its entirety.

What is claimed is:

1. A toner comprising:

a toner particle containing:

an amorphous polyester serving as a binder resin, a polymer A, and a wax; and inorganic fine particles, wherein the polymer A includes a graft copolymer of a polyolefin and a vinyl-based polymer unit having a carboxylate anion group, and a metal ion having a valence of 2 or more, an amount of the metal ion in the polymer A is 4.2 mass % or more and 13.8 mass % or less with respect to a mass of the polymer A, the metal ion is an aluminum ion, and an amount of the wax is 4 parts by mass or more and 12 parts by mass or less with respect to 100 parts by mass of the binder resin.

2. The toner according to claim 1, wherein an amount of the metal ion in the polymer A is 4.2 mass % or more and 10 mass % or less with respect to a mass of the polymer A.

3. The toner according to claim 1, wherein a content of the polymer A in the toner is 4.0 mass % or more and 12.0 mass % or less with respect to the mass of the toner.

4. The toner according to claim 1, wherein the amount of the wax is 6 parts by mass or more and 10 parts by mass or less with respect to 100 parts by mass of the binder resin.

* * * * *